US007750786B2

(12) United States Patent
Last et al.

(10) Patent No.: US 7,750,786 B2
(45) Date of Patent: Jul. 6, 2010

(54) ELECTROMAGNETIC COIL

(75) Inventors: Holger Last, Hannover (DE); Robert Rüther, Hemmingen (DE); Dimitri Krou, Lehrte (DE); Thomas Groetzinger, Gehrden (DE)

(73) Assignee: Nass Magnet GmbH, Hannover (DE)

( * ) Notice: Subject to any disclaimer, the term of this patent is extended or adjusted under 35 U.S.C. 154(b) by 0 days.

(21) Appl. No.: 12/046,544

(22) Filed: Mar. 12, 2008

(65) Prior Publication Data

US 2008/0309447 A1 Dec. 18, 2008

(30) Foreign Application Priority Data

Mar. 13, 2007 (DE) ..... 10 2007 012 101

(51) Int. Cl.

*H01F 27/29* (2006.01)
*H01F 21/04* (2006.01)
*H01F 21/06* (2006.01)
*H01F 27/30* (2006.01)

(52) U.S. Cl. ..... 336/192; 336/77; 336/117; 336/118; 336/198; 336/208

(58) Field of Classification Search ..... None
See application file for complete search history.

(56) References Cited

U.S. PATENT DOCUMENTS 3,711,805 A * 1/1973 Heijnen et al. ..... 336/65
5,774,036 A * 6/1998 Hrytzak et al. ..... 336/192
5,999,079 A * 12/1999 Wille ..... 336/192
6,369,682 B1 * 4/2002 Thompson et al. ..... 336/192
6,476,703 B2 * 11/2002 Geltsch et al. ..... 336/192
7,293,757 B2 * 11/2007 Akabane ..... 251/129.21
2003/0107464 A1 * 6/2003 Gutierrez et al. ..... 336/208
2004/0252003 A1 * 12/2004 Linkner et al. ..... 336/208
2005/0225418 A1 * 10/2005 Tran-Ngoc et al. ..... 336/198
2007/0007477 A1 * 1/2007 Hamada et al. ..... 251/129.15
2007/0290155 A1 12/2007 Jacobus

FOREIGN PATENT DOCUMENTS

JP 10-173398 * 6/1998

* cited by examiner

*Primary Examiner*—Lincoln Donovan
*Assistant Examiner*—Mangtin Lian
(74) *Attorney, Agent, or Firm*—Stites & Harbison PLLC; Ross F. Hunt, Jr.; Douglas E. Jackson

(57) ABSTRACT

The electromagnetic coil according to the invention has a coil core, a winding of coil wire and two contact pins, the contact pins being secured to at least one resilient holding member and being movable relative to the coil core. The holding member is formed in a unitary manner with the coil core, and the ends of the coil wire are secured to the movable/resilient contact pins.

12 Claims, 3 Drawing Sheets

ELECTROMAGNETIC COIL

Figure 1:
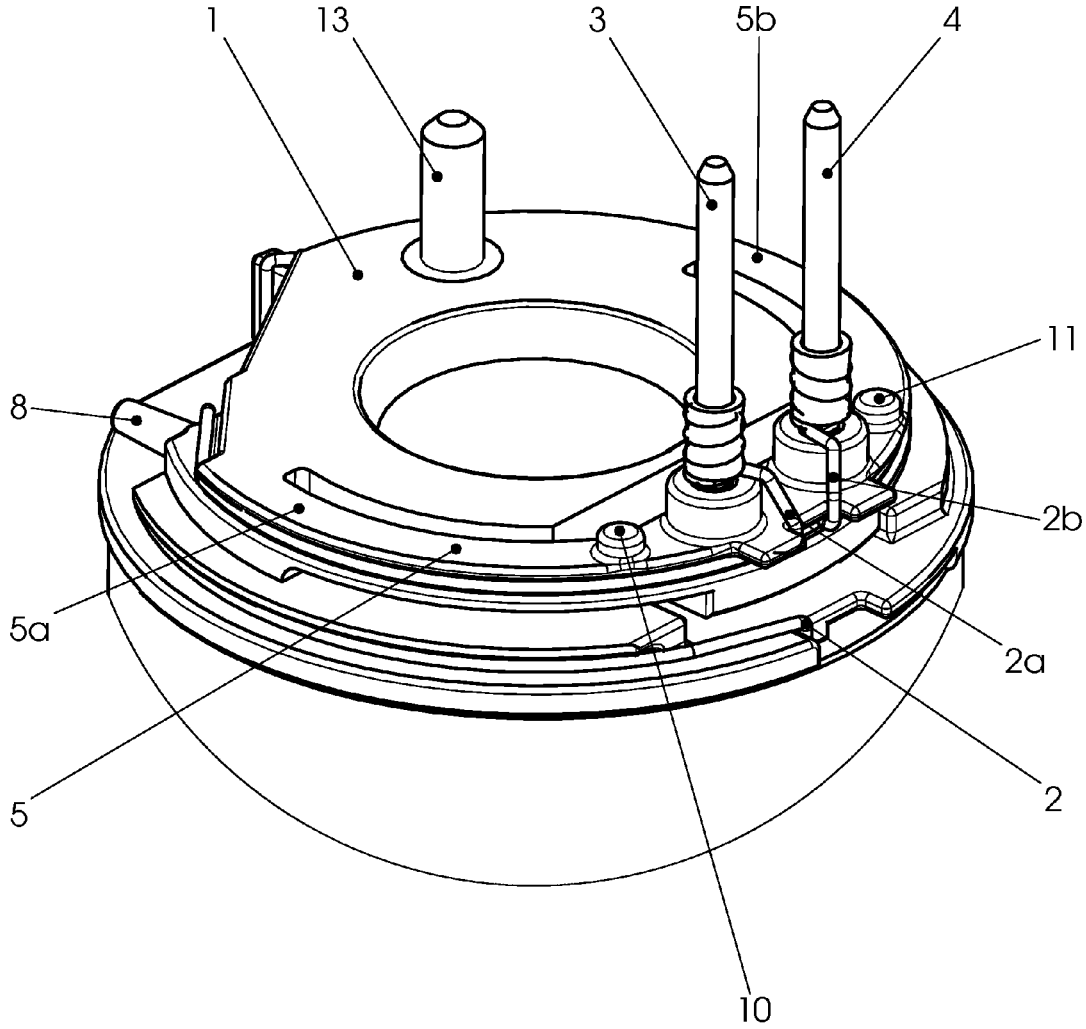

The invention relates to an electromagnetic coil having a coil core, a winding of coil wire and two contact pins to which the ends of the coil wire are connected.

When an electromagnetic coil is in use, relative movements may occur which are transferred onto the contact pins by way of a soldered-on printed circuit board or a plug and which, as a result, lead to a load on the contact.

According to DE-A-10 2004 051 331, the ends of the coil wire are fixed to contact bows which are inserted into recesses in a holding device. A portion of the contact bows which projects from the recess forms a contact pin.

The object of the invention is therefore to improve the electromagnetic coil to the effect that the load is removed from the contact.

That object is achieved according to the invention by the features of claim 1.

The electromagnetic coil according to the invention has a coil core, a winding of coil wire and two contact pins, the contact pins being secured to at least one resilient holding member and being movable relative to the coil core. The holding member is formed in a unitary manner with the coil core, and the ends of the coil wire are secured to the movable/resilient contact pins.

The resilient contact pins can compensate for any relative movements and thereby prevent undesired loading of the contact.

Further developments of the invention are the subject-matter of the subordinate claims.

The holding member can be retained on one side or two sides of the coil core, for example a bow-shaped configuration being provided.

If the holding member is retained at its two end regions on the coil core, the contact pins are secured in a central region of the holding member.

According to a further development, the holding member has recesses, especially grooves, for receiving the coil wire leading from the coil core to the contact pins. The coil wire is advantageously retained in the recesses in the region of the holding member extending from the contact pins as far as the site at which the holding member is fitted to the coil core. According to a further development of the invention, a wire-deflector is provided in order to deflect the coil wire leading from the coil core to the contact pins before it is received in the recess of the holding member. The wire-deflector especially facilitates operation with an automatic winding device.

Further advantages and developments of the invention are explained in more detail hereinafter by means of the description of an embodiment and the drawings.

Figure 2:
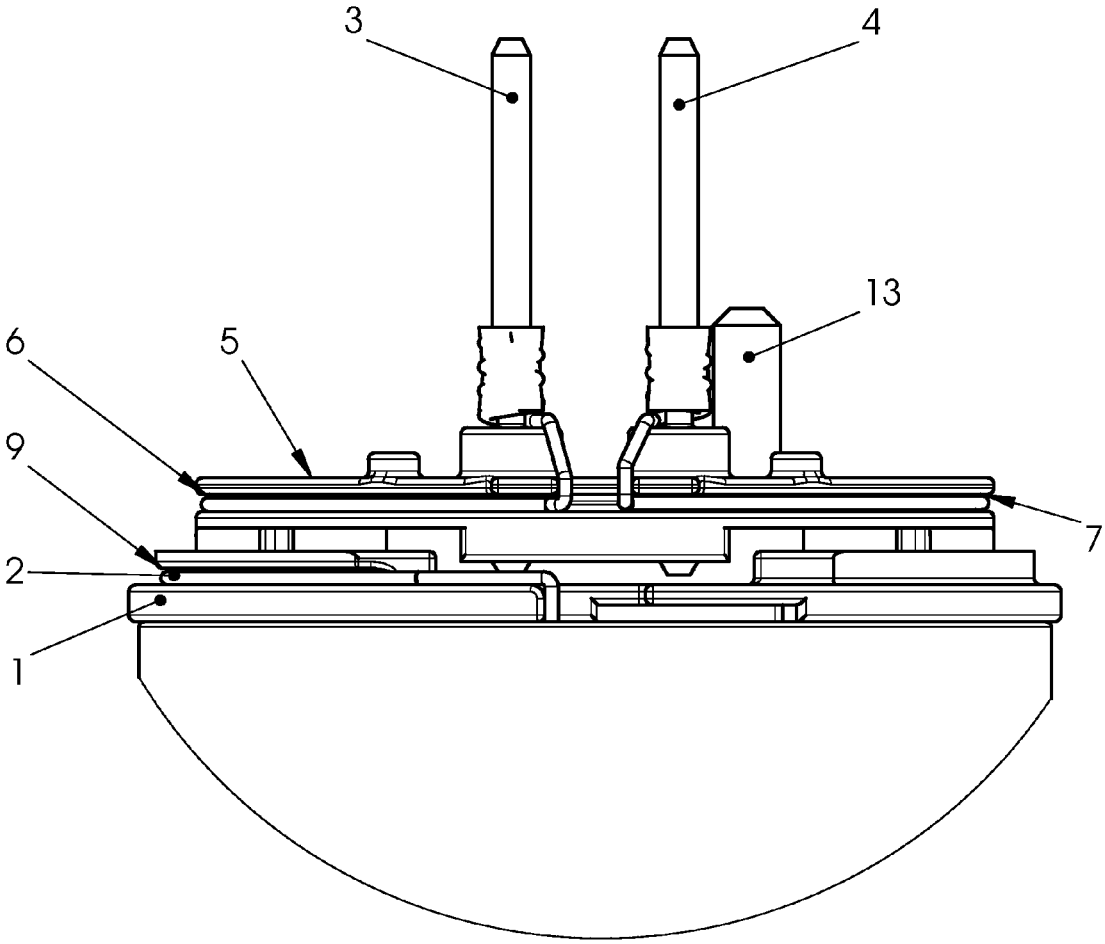
Figure 3:
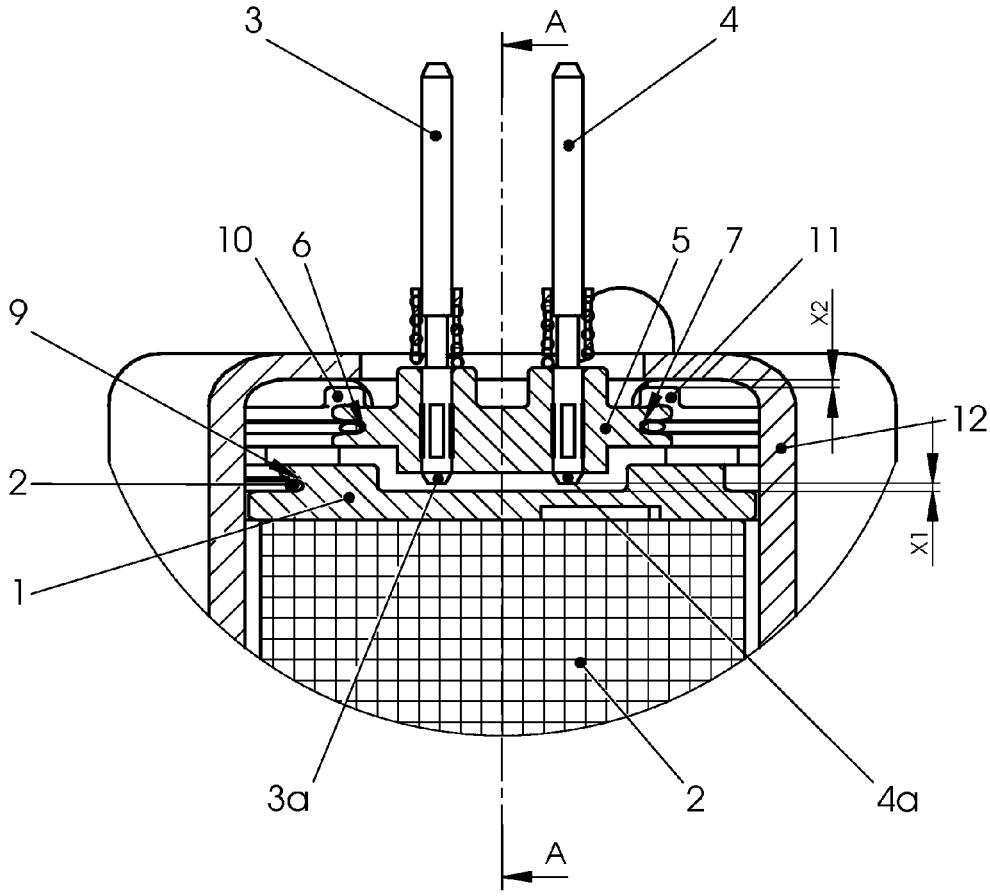
Figure 4:
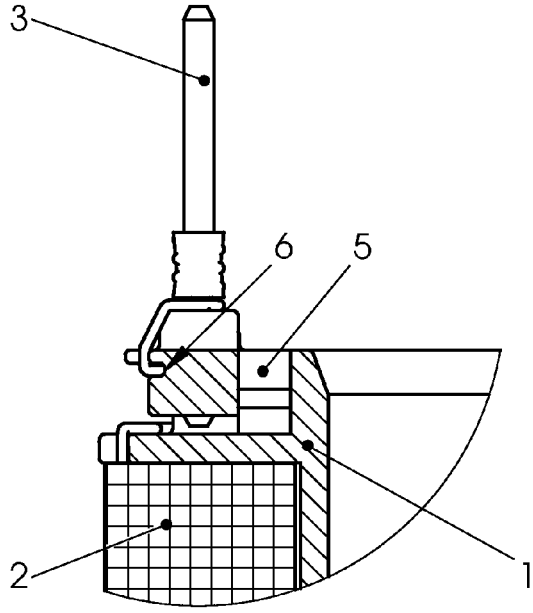

In the drawings:

FIG. 1 is a three-dimensional view of the electromagnetic coil in the region of the contact pins, FIG. 2 is a schematic side view of FIG. 1, FIG. 3 is a sectional view of the electromagnetic coil in the region of the contact pins, FIG. 4 is a sectional view along the line A-A of FIG. 3.

The electromagnetic coil shown in the drawings has a coil core 1 having a winding of coil wire 2, and two contact pins 3, 4. The two ends 2*a*, 2*b* of the coil wire 2 are secured to the contact pins 3 and 4, respectively. This can be effected, for example, by soldering or winding on.

The contact pins 3, 4 are secured to a resilient holding member 5 which, in the embodiment shown, is bow-shaped and formed in a unitary manner with the coil core. The holding member is here retained on the coil core by its two end regions 5*a*, 5*b*, the contact pins 3, 4 being secured in a central region of the holding member. Although in the embodiment shown the two contact pins 3, 4 are arranged on the same holding member, within the scope of the invention it is also possible to provide a separate resilient holding member for each contact pin.

In the region of the holding member 5 extending from the contact pins 3 and 4, respectively, at least as far as the site at which the holding member is fitted to the coil core, the coil wire 2 is guided in recesses 6, 7. This ensures that the contact pins 3, 4 are movable relative to the coil core 1 but that, on the other hand, the coil wire is not damaged by these relative movements.

In order to facilitate the laying of the coil wire in the recesses 6, 7, especially in the case of an automatic winding device, a wire-deflector 8 (FIG. 1) is provided. The coil wire 2 coming from the winding can be guided in a groove 9 formed in the coil core 1 even before the wire-deflector 8. The wire-deflector 8 thus deflects the coil wire from the groove 9 of the coil core into the recess 6 or 7 of the holding member 5.

The travel of the holding member 5 can be limited by stops in both directions. In the embodiment shown, stops 10, 11 which cooperate, for example, with a yoke 12 of the electromagnetic coil, are provided on one side of the holding member. According to FIG. 3, a travel X2 is possible from the central position of the holding member 5.

In the embodiment shown, the stops in the other direction of movement are formed by the lower ends 3*a*, 4*a* of the contact pins 3, 4 which cooperate with an opposite surface, especially the coil core 1, and permit a travel X1.

The resilient properties of the holding member 5 can be adjusted by its geometry (length, width, thickness).

The electromagnetic coil is also provided with positioning means, especially a positioning peg 13, which is preferably formed in one piece with the coil core 1. This positioning peg is used to align the coil or for the correct orientation of the movable, or resilient, contact pins 3, 4 in a housing.

The unitary or one-piece form of the holding member 5 with the coil core 1 permits inexpensive manufacture. Moreover, damage to the coil wire is avoided owing to its accommodation in the recess or groove of the holding member 5.

The invention claimed is:

1. Electromagnetic coil comprising:

a coil core, a winding of coil wire and two contact pins, at least one resilient holding member to which the contact pins are secured whereby the contact pins are movable relative to the coil core, and wherein the resilient holding member is formed in a unitary manner with the coil core, wherein ends of the coil wire are secured directly to the movable/resilient contact pins, and wherein the resilient holding member has recesses therein for receiving respective portions of the coil wire leading from the coil core to the ends connected to the contact pins, wherein the portions of the coil wire are retained in the respective recesses in the resilient holding member extending from the contact pins as far as a site where the resilient holding member is fitted to the coil core.

2. Electromagnetic coil according to claim 1, wherein a portion of the coil wire leading to the contact pins is guided on the resilient holding member.

3. Electromagnetic coil according to claim 1, wherein the resilient holding member is bow-shaped.

4. Electromagnetic coil according to claim 1, wherein the coil wire is retained in the recesses in the region of the resilient holding member extending from the contact pins as far as the site where the resilient holding member is fitted to the coil core.

5. Electromagnetic coil according to claim 1, wherein a wire-deflector is provided in order to deflect the portion of the coil wire leading from the coil core to the contact pins before the portion of the coil wire is received in the recess of the resilient holding member.

6. Electromagnetic coil according to claim 5, wherein the coil core has a groove in which the portion of the coil wire leading to the contact pins is guided, the wire-deflector deflecting the portion of the coil wire from the groove of the coil core into the recess of the resilient holding member.

7. Electromagnetic coil according to claim 1, wherein the resilient holding member is retained at two end regions thereof on the coil core, and the contact pins are secured in a central region of the resilient holding member (5).

8. Electromagnetic coil according to claim 1, wherein one or more stops are provided to limit the travel of the resilient holding member relative to the coil core.

9. Electromagnetic coil according to claim 8, wherein the stops in at least one direction of movement are formed by ends of the contact pins.

10. Electromagnetic coil according to claim 1, further including a positioning means for aligning the coil in a housing, which positioning means is formed in one piece with the coil core.

11. Electromagnetic coil according to claim 10, wherein the positioning means includes at least one positioning peg.

12. Electromagnetic coil according to claim 1, wherein the recesses are grooves.

* * * * *